US011395379B2

(12) United States Patent
De la Cuerda Ortin et al.

(10) Patent No.: US 11,395,379 B2
(45) Date of Patent: Jul. 19, 2022

(54) COOKING DEVICE AND METHOD FOR ASSEMBLING A COOKING DEVICE

(71) Applicant: BSH Hausgeräte GmbH, Munich (DE)

(72) Inventors: Jose Maria De la Cuerda Ortin, Saragossa (ES); Juan Jose Galindo Perez, Saragossa (ES); Pablo Jesus Hernandez Blasco, Saragossa (ES); Izaskun Jaca Equiza, Saragossa (ES); Ignacio Lope Moratilla, Saragossa (ES); Damaso Martin Gomez, Saragossa (ES); Maria Elena Moya Albertin, Saragossa (ES); Carlos Obon Abadia, Saragossa (ES); Jose Joaquin Paricio Azcona, Saragossa (ES); Alvaro Rigual Iturria, Saragossa (ES); Pablo Ruiz Arnal, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 489 days.

(21) Appl. No.: 16/467,507

(22) PCT Filed: Dec. 12, 2017

(86) PCT No.: PCT/IB2017/057826
§ 371 (c)(1),
(2) Date: Jun. 7, 2019

(87) PCT Pub. No.: WO2018/116062
PCT Pub. Date: Jun. 28, 2018

(65) Prior Publication Data

US 2020/0077472 A1 Mar. 5, 2020

(30) Foreign Application Priority Data

Dec. 23, 2016 (ES) ..... ES201631671

(51) Int. Cl.
*H05B 6/12* (2006.01)
*H05B 6/36* (2006.01)

(52) U.S. Cl.
CPC ..... *H05B 6/129* (2013.01); *H05B 6/36* (2013.01); *H05B 6/362* (2013.01)

(58) Field of Classification Search
CPC ..... F24C 7/06; H05B 2206/022; H05B 3/06; H05B 3/68; H05B 6/1245; H05B 6/129; H05B 6/36; H05B 6/362; Y02B 40/00
(Continued)

(56) References Cited

U.S. PATENT DOCUMENTS

2008/0184983 A1 8/2008 Baek et al.
2010/0206871 A1* 8/2010 Kataoka ..... H05B 6/1209 219/622

(Continued)

FOREIGN PATENT DOCUMENTS

CN 203181264 U 9/2013
CN 103634958 A 3/2014

(Continued)

OTHER PUBLICATIONS

National Search Report ES P201631671 dated Oct. 20, 2017.

(Continued)

*Primary Examiner* — Quang T Van
(74) *Attorney, Agent, or Firm* — Michael E. Tschupp; Andre Pallapies; Brandon G. Braun

(57) ABSTRACT

A cooking device includes a heating coil having at least two windings. A fixing device is provided to fix the heating coil at least partially mechanically in an assembled state. The fixing device includes a support unit and a retaining unit, which in the assembled state fixes each of the at least two windings separately on the support unit.

23 Claims, 7 Drawing Sheets

(58) Field of Classification Search
USPC ..... 219/620, 622, 624, 626, 628, 629, 630, 219/632, 634, 650, 653, 672, 675, 670, 219/699, 680
See application file for complete search history.

(56) References Cited

U.S. PATENT DOCUMENTS

| | | | | |
|---|---|---|---|---|
| 2011/0084058 | A1 | 4/2011 | Kim et al. | |
| 2011/0155723 | A1 | 6/2011 | Liu et al. | |
| 2013/0098901 | A1* | 4/2013 | Corleoni ..... | H05B 6/02 219/620 |

FOREIGN PATENT DOCUMENTS

| | | | |
|---|---|---|---|
| CN | 204334999 | U | 5/2015 |
| CN | 205584529 | U | 9/2016 |
| CN | 106091043 | A | 11/2016 |
| DE | 3820691 | A1 | 12/1989 |
| DE | 102008020150 | A1 | 10/2008 |
| DE | 102012220775 | A1 | 6/2013 |
| EP | 2746671 | A1 | 6/2014 |
| ES | 2079293 | A2 | 1/1996 |
| ES | 2322978 | A1 | 7/2009 |
| GB | 335160 | | 9/1930 |
| JP | 2011228147 | A | 11/2011 |
| WO | 2013080404 | A1 | 6/2013 |

OTHER PUBLICATIONS

International Search Report PCT/IB2017/057826 dated Mar. 28, 2018.
National Search Report CN 201780079741.5 dated Mar. 3, 2021.

* cited by examiner

COOKING DEVICE AND METHOD FOR ASSEMBLING A COOKING DEVICE

CROSS-REFERENCES TO RELATED APPLICATIONS

This application is the U.S. National Stage of International Application No. PCT/IB2017/057826, filed Dec. 12, 2017, which designated the United States and has been published as International Publication No. WO 2018/116062 A1 and which claims the priority of Spanish Patent Application, Serial No. P201631671, filed Dec. 23, 2016, pursuant to 35 U.S.C. 119(a)-(d).

BACKGROUND OF THE INVENTION

The invention relates to a cooking device and a method for assembling a cooking device.

Cooking appliances with a number of heating coils, which are mechanically fixed in an assembled state by means of a fixing device, are known from the prior art.

BRIEF SUMMARY OF THE INVENTION

The object of the invention is in particular to provide a generic cooking device with improved properties as regards stability.

The invention is based on a cooking device, in particular an oven device and advantageously an induction oven device, with at least one heating coil, which has at least two, advantageously at least four and particularly preferably at least eight, windings, and with at least one fixing device, which mechanically fixes the heating coil in an assembled state at least partially, in particular at least for the most part and particularly preferably completely.

It is recommended that the fixing device comprises a support unit and a retaining unit, in particular embodied separately from the support unit, which in the assembled state fixes each of the windings separately to the support unit, in particular in such a way that a mechanical movement of the windings relative to each other and/or relative to the support unit is at least essentially prevented.

In this connection a "cooking device" should in particular be taken to mean at least one part, in particular a subassembly, of a cooking appliance, in particular of a cooktop, of a grill appliance, a microwave oven and/or preferably of an oven. The cooking appliance is here advantageously embodied as an induction cooling appliance, in particular as an induction cooktop, as an induction grill, as an induction microwave oven and/or particularly preferably as an induction oven. A "heating coil" should in particular be taken to mean an advantageously inductive element, in particular a heating element, which in particular consists of at least one, preferably exactly one heating cable, in particular a heating conductor, and in particular has a multiplicity of windings, in particular in a number of planes and/or advantageously in one plane. Viewed from above, the heating coil can in particular have a circular, an oval and/or preferably a rectangular form and/or contour. The heating coil could here for example be embodied as a resistance heating element. Advantageously, however, the heating coil is embodied as an induction heating element. In this connection, a "winding" of a heating coil should be taken to mean in particular exactly one circulation of the heating coil, in particular of the heating cable of the heating coil through 360°, in particular relative to a central reference point, in particular a geometric center of the heating coil and in particular when viewed perpendicular to a main extension plane of the heating coil. The word "provided" should in particular be taken to mean specially designed and/or equipped. That an object is provided for a particular function should in particular be taken to mean that the object fulfills and/or performs this particular function in at least one usage and/or operating status.

In this connection a "support unit" should in particular be taken to mean an, advantageously at least partially shape-retaining, unit, which is provided to bear an object arranged on and/or over the support unit, in particular the heating coil, and here in particular to take up, at least partially the weight of the object, in particular of the heating coil. To this end, the support unit can comprise in particular at least one support element or a multiplicity of support elements. The at least one support element here preferably consists at least partially and preferably at least for the most part of a solid material, in particular plastic and/or preferably electrically insulating material, preferably mica. Particularly preferably, at least two of the support elements are further arranged in a common plane. In this connection, a "retaining unit" should in particular be taken to mean a unit which is provided to fix the object arranged in particular on and/or over the support unit, in particular the heating coil and preferably each winding of the heating coil, separately on the support unit, preferably in a friction-locked and/or form-fitted manner, so that in particular a mechanical movement of the object, in particular of the heating coil and preferably each winding of the heating coil, is at least essentially prevented. To this end, the retaining unit preferably comprises at least two, preferably at least four and particularly preferably at least eight retaining elements in particular embodied separately from each other, wherein at least one of the retaining elements is preferably assigned to each of the windings. The indication that the retaining unit "in the assembled state fixes each of the windings separately to the support unit", should in particular be taken to mean that the retaining unit connects each of the windings separately to the support unit for fixing of the heating coil. The retaining unit here advantageously encompasses each of the windings at least for the most part. Particularly preferably, at least one retaining element of the retaining unit enables, in each case individually, an advantageously friction-locked and/or form-fitted fixing of an area of an individual winding of the heating coil to at least one support element of the support unit, in particular spatially separated from at least one further retaining element of the retaining unit. The expression "at least essentially prevents" should further in particular be taken to mean that a maximum freedom of movement of the windings relative to each other and/or relative to the support unit amounts to at most 5 mm, advantageously at most 1 mm, preferably at most 2 mm and particularly preferably at most 0.5 mm. Further, the expression "at least for the most part" should be taken to mean in particular at least 55%, advantageously at least 65%, preferably at least 75%, particularly preferably at least 85% and particularly advantageously at least 95%. An advantageous stability can in particular be achieved by means of this embodiment of the cooking device. In particular, a stable spatial fixing of the heating coil with different geometries can be achieved, including in the case of high temperatures exceeding 500° C., without functional limitation. In addition, an advantageously simple assembly and/or manufacture can be achieved, by means of which in particular material and/or costs can be saved.

In one preferred embodiment it is recommended that the retaining unit consists at least partially, preferably at least for the most part and particularly preferably completely, of a material with a thermal expansion coefficient which is at least essentially identical to a thermal expansion coefficient of the heating coil. Here, at least one retaining element of the retaining unit preferably consists of a metal, in particular an alloy and/or advantageously steel and/or copper. In particular an at least partially uniform thermal expansion of the heating coil and/or of the retaining unit can hereby be achieved and in particular a stable fixing of the heating coil attained.

It is additionally recommended that the retaining unit comprises a multiplicity of advantageously disconnected and/or separate, retaining elements, in particular the aforementioned retaining elements, wherein at least two of the retaining elements are assigned to at least one of the windings. In this case, the retaining elements are advantageously arranged in the circumferential direction of the winding. Particularly preferably, at least two, preferably at least three and particularly preferably at least four retaining elements are assigned to at least one of the windings and advantageously to each of the windings of the heating coil. A particularly stable fixing of the windings on the support unit can hereby advantageously be achieved.

In one particularly preferred embodiment of the invention it is recommended that the retaining unit is embodied at least partially in one piece with the heating coil. In this connection, indicating that an object is "embodied at least partially in one piece" with a further object, should in particular be taken to mean that the objects have at least one common component and/or at least one component of the object and/or the object is connected and/or embodied in one piece with at least one component of the further object and/or the further object. Preferably, however, all components of the object are embodied in one piece with at least one component of the further object. In this connection, "in one piece" should in particular be taken to mean at least connected in a bonded manner and/or embodied with each other. The bonding can for example be created by means of an adhesive process, a spray process, a welding process, a soldering process and/or another process. In one piece should advantageously be taken to mean formed from one piece and/or in one piece. This one piece is preferably manufactured from a single blank, a shape and/or a casting. In particular, at least one retaining element of the retaining unit is embodied in one piece with the heating coil. Material and/or production costs can thereby be advantageously saved and in particular assembly effort reduced.

An advantageously simple and/or space-saving fixing of the windings can in particular be achieved if the retaining unit has at least one retaining element, which is embodied as a retaining clasp, retaining hook, retaining clip and/or retaining bolt. In particular the retaining unit can have at least one retaining element, which has an extension in the direction of a winding loop of the heating coil, which amounts to at most 40%, preferably at most 30% and particularly preferably at most 20% of a material extension, in particular a material thickness, of the windings, in particular viewed perpendicular to a main extension plane of the heating coil. The expression "main extension plane" of an object should in particular be taken to mean a plane which is parallel to a largest lateral face of a smallest, in particular notional, cuboid, which only just completely encloses the object, and which in particular runs through a center, in particular a geometric center, of the cuboid.

In one particularly preferred embodiment of the invention it is recommended that the support unit is embodied at least partially, preferably at least for the most part and particularly preferably completely, to be electrically insulating. In particular, the support unit here consists at least partially of an electrically insulating material, in particular of mica and/or plastic. Increased operating safety can thereby in particular be guaranteed and operating costs can advantageously be reduced.

It is further recommended that the support unit comprises a multiplicity of at least essentially strip-like support elements. An "at least essentially strip-like object" should in particular be taken to mean an object which has a form and/or contour which diverges from a strip-like reference object by a proportion of its area of at most 15%, advantageously at most 10% and particularly preferably at most 5%. A fixing of the windings in all spatial directions can thereby be advantageously increased.

It is further recommended that in an assembled state the support elements are arranged at least essentially perpendicular to each other. That the support elements "are arranged essentially perpendicular to each other" should here in particular be taken to mean that the longitudinal axes of two adjacent strip-type support elements along the direction of the windings of the heating coil enclose an angle which in particular diverges by less than 12°, advantageously less than 7° and particularly advantageously less than 2° form 90°. An advantageously simple and in particular stable orientation can thereby be achieved.

It is additionally recommended that the support unit has at least one retaining recess for accommodating the retaining unit. The support unit preferably has a multiplicity of retaining recesses. The number of retaining recesses is particularly preferably matched to the number of retaining elements. Advantageously, one of the retaining recesses is here assigned to each of the retaining elements. The retaining recesses are here preferably embodied as an opening corresponding to the retaining element. Assembly can thereby in particular be facilitated and/or a stable fixing achieved.

It is further recommended that the cooking device comprises a positioning unit, which is provided for positioning of the retaining unit and/or of the support unit relative to the heating coil. A "positioning unit" should in particular be taken to mean in particular a unit with at least one positioning element, which is provided in particular to orient the retaining unit, the support unit and/or the heating coil relative to each other. The positioning unit is preferably embodied in one piece with the heating coil. The positioning element could for example be embodied in the form of a hook. However the positioning element is preferably embodied as a notch, preferably in the form of an advantageously bilateral recess of the heating coil, in particular of the heating cable of the heating coil and/or a recess in the center of the heating coil. The positioning unit preferably has a multiplicity of positioning elements. Particularly preferably, the number of positioning elements is matched to the number of retaining elements. One of the positioning elements is here advantageously assigned to each of the retaining elements. An advantageously simple orientation can thereby in particular be achieved.

In addition, a method for assembly of a cooking device is recommended, which has at least one heating coil with at least two windings and which has at least one fixing device, which mechanically fixes the heating coil in an assembled state at least partially, in particular at least for the most part and particularly preferably completely, wherein each of the windings is fixed separately to a support unit of the fixing device by means of a retaining unit of the fixing device. An advantageous stability can thereby in particular be achieved.

In particular, a stable spatial fixing of the heating coil with different geometries can be achieved, including in the case of high temperatures exceeding 500° C., without functional limitation. In addition, an advantageously simple assembly and/or production can thereby be achieved, by means of which in particular material and/or costs can be saved.

Further advantages emerge from the following description of the drawing. The drawing shows exemplary embodiments of the invention. The drawing, the description and the claims contain numerous features in combination. The person skilled in the art will expediently also consider the features individually, and put them together into sensible further combinations.

BRIEF DESCRIPTION OF THE DRAWINGS

Wherein.

DETAILED DESCRIPTION OF EXEMPLARY EMBODIMENTS OF THE PRESENT INVENTION

Figure 1:
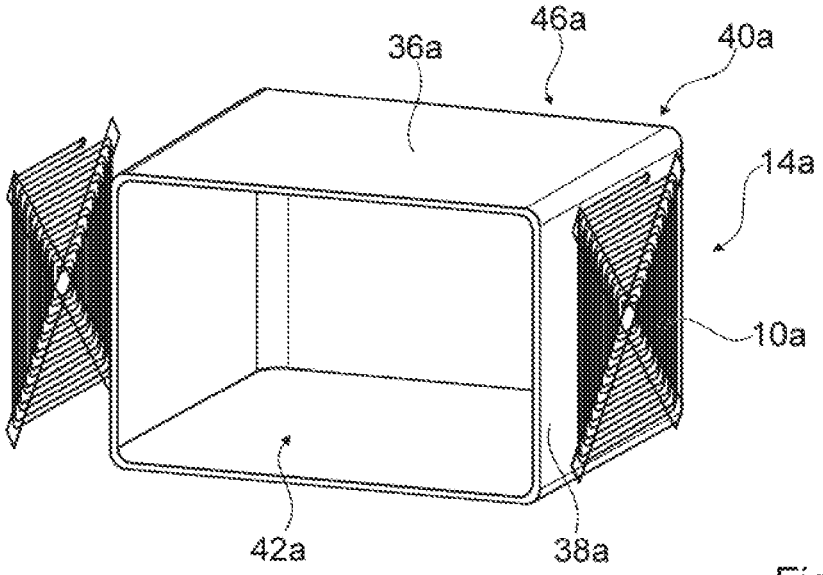
FIG. 1 shows a cooking appliance embodied, by way of example, as an induction oven with a cooking device, in a schematic representation.

FIG. 1 shows a cooking appliance 40*a* in a perspective view. In the present case the cooking appliance 40*a* is embodied, by way of example, as an oven, in the present case in particular as induction oven. Alternatively, a cooking appliance could also be embodied as an induction grill appliance, as a microwave oven or as an induction cooktop.

The cooking appliance 40*a* comprises a cooking device. The cooking device comprises a cooking appliance housing 46*a*. The cooking appliance housing 46*a* defines a cooking compartment 42*a*. To this end, the cooking appliance housing 46*a* comprises an external housing (not shown) and a muffle 36*a* with at least one muffle wall 38*a* arranged within the external housing, delimiting the cooking compartment 42*a*. In addition, the muffle 36*a* comprises further muffle walls, which for the sake of clarity are not provided with reference characters. In addition, the cooking device comprises an appliance closure element (not shown). The appliance closure element is in the present case embodied as an appliance flap. The appliance closure element is provided to close the cooking compartment 42*a*. Alternatively, however, an appliance closure element could also be embodied as an appliance door.

The cooking device further comprises a heating coil 10*a*. The heating coil 10*a* is arranged in the cooking appliance housing 46*a*. The heating coil 10*a* is arranged flat on the muffle wall 38*a*. In the present case the heating coil 10*a* is embodied as an induction heating element. The heating coil 10*a* is provided to effect heating of the muffle wall 38*a* by means of an alternating electromagnetic field. The heating coil 10*a* is further provided to heat foodstuffs to be cooked located in the cooking compartment 42*a*.

In addition, the cooking device comprises a fixing device 14*a*. The fixing device 14*a* is arranged in the cooking appliance housing 46*a*. The fixing device 14*a* is arranged on the heating coil 10*a*. The fixing device 14*a* is provided to fix the heating coil 10*a* mechanically in an assembled state. In addition, the cooking device comprises further heating coils and further fixing devices arranged on the further muffle walls, which are at least essentially structurally identical to the heating coil 10*a* and the fixing device 14*a* and to which, for the sake of clarity, no reference character has been assigned.

Figure 2A:
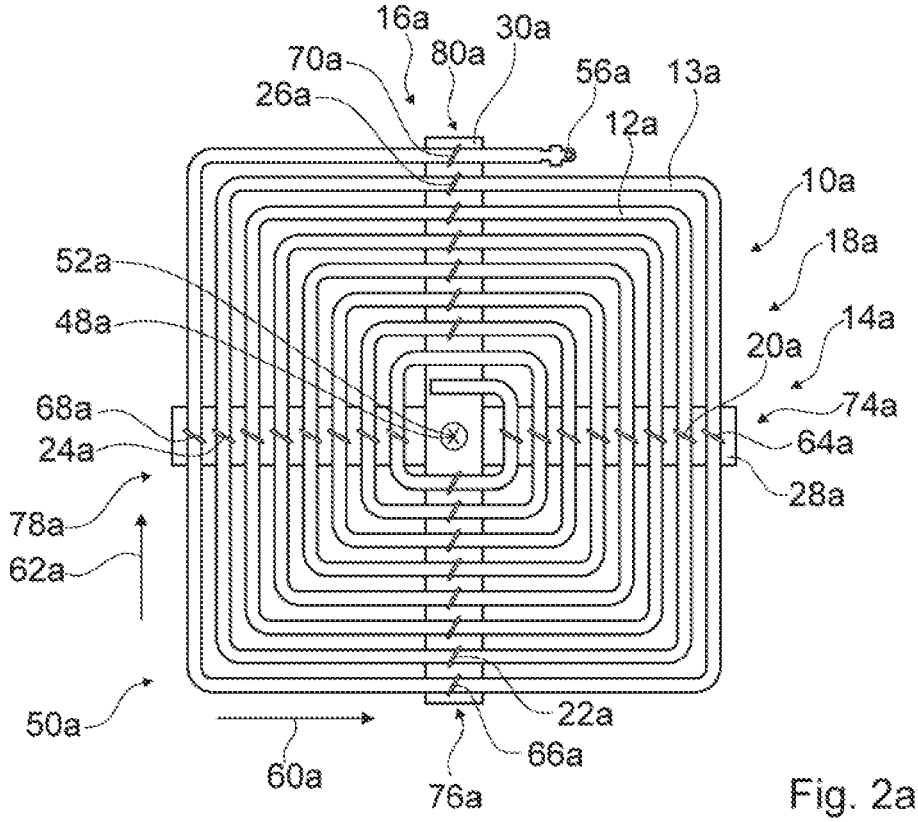
FIG. 2*a* shows a heating coil and a fixing device of the cooking device in an assembled state.
Figure 2B:
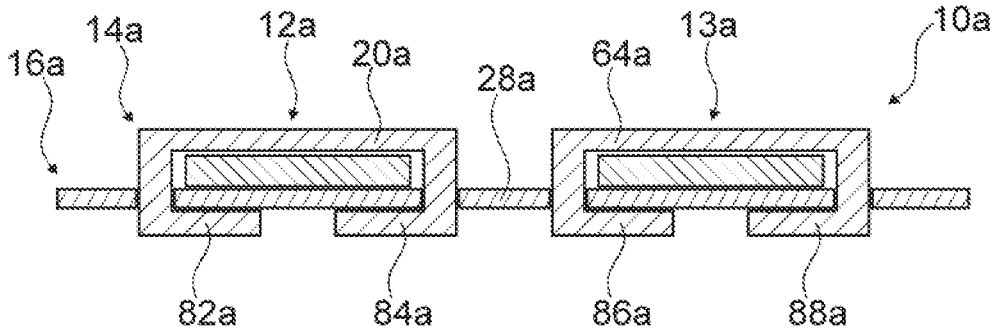
FIG. 2*b* shows a first detail view of the heating coil and the fixing device.
Figure 2C:
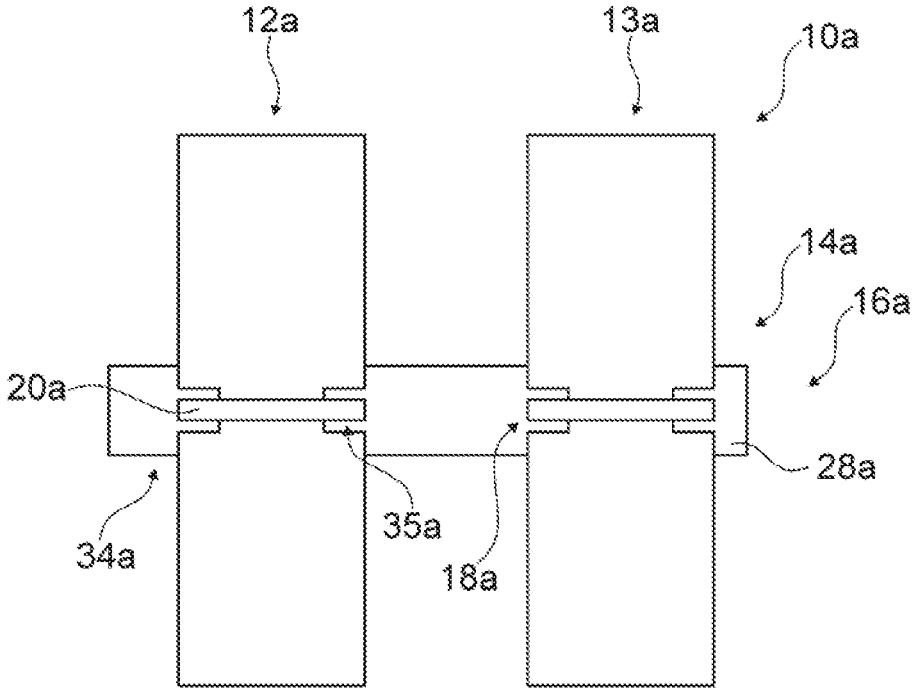
FIG. 2*c* shows a second detail view of the heating coil and the fixing device.

FIGS. 2*a*, 2*b* and 2*c* show the heating coil 10*a* and the fixing device 14*a* in a number of detailed representations. The description that follows can here also be transferred to the further heating coils and fixing devices, in particular as a result of the at least essentially structurally identical embodiment.

The heating coil 10*a* is embodied from a ribbon-like heating conductor, which in particular in the present case has a rectangular cross-section. The heating coil 10*a* is embodied from a single heating conductor. The heating coil 10*a* is embodied in copper. The heating coil 10*a* comprises a multiplicity of windings 12*a*, 13*a*. In the present case the heating coil 10*a* comprises a total of eight windings 12*a*, 13*a*, wherein in FIGS. 2*a* to 2*c*, for the sake of clarity, only two of the windings 12*a*, 13*a* are provided with a reference character and/or are represented. The windings 12*a*, 13*a* of the heating coil 10*a* form a flat coil plane 50*a*. All windings 12*a*, 13*a* of the heating coil 10*a* are here arranged in the coil plane 50*a*. Additionally, the heating coil 10*a* has a coil center point 48*a* arranged in the coil plane 50*a*, around which the windings 12*a*, 13*a* extend. In addition, the heating coil 10*a* has a coil axis 52*a* which is oriented perpendicular to the coil plane 50*a* and in particular runs through the coil center point 48*a*.

When viewed in the direction of the coil axis 52*a*, the heating coil 10*a* has a rectangular form and/or contour. Alternatively, however, a heating coil could also have a circular and/or oval form and/or contour. In principle it is further also conceivable to embody a heating coil from a multiplicity of heating conductors and/or one stranded conductor. A heating coil could also be embodied at least partially from a material other than copper, such as for example silver and/or gold. In addition, a heating coil could comprise a number of windings other than eight.

The heating coil 10*a* additionally has a connection element 56*a* at one end. The connection element 56*a* is embodied as an annular aperture. The connection element 56*a* is embodied as a lug. The connection element 56*a* is provided for connection of the heating coil 10*a* to a source of current. Alternatively, a connection element can be embodied as copper wire.

The fixing device 14*a* comprises a support unit 16*a*. The support unit 16*a* is at least essentially arranged in a plane. The support unit 16*a* is arranged in a plane which is arranged parallel to the coil plane 50*a*. The support unit 16*a* is provided to take up, at least partially, the weight of the heating coil 10*a*. The support unit 16*a* is further provided to orient the windings 12*a*,13*a* of the heating coil 10*a* relative to each other.

To this end the support unit 16*a* comprises a number of support elements 28*a*, 30*a*, although it can be a single element that comprises all or most of the surface of the heating coil 10. In the present case the support unit 16*a* comprises two support elements 28*a*, 30*a*, in particular a first support element 28*a* and a second support element 30*a*. The support elements 28*a*, 30*a* are in the present case at least essentially structurally identical. Alternatively, a support unit can comprise only a single support element or at least three and/or at least four support elements. In addition, a first and a second support element could be embodied differently from each other.

The first support element 28*a* is embodied in longitudinal form, and defines a first longitudinal extension direction 60*a*. The first support element 28*a* is embodied as a rigid body. The first support element 28*a* is embodied in elongated form. The first support element 28*a* is embodied in a strip-like manner. The first support element 28*a*, in particular a wing of the first support element 28*a*, is oriented parallel to the heating coil 10*a*, in particular the coil plane 50*a*. The first support element 28*a* extends from a first longitudinal side of the heating coil 10*a* to a second longitudinal side of the heating coil 10*a* lying opposite the first longitudinal side. The first longitudinal extension direction 60*a* of the first support element 28*a* here runs through the coil axis 52*a*. The first support element 28*a* is further embodied from an electrically insulating material. In the present case, the first support element 28*a* is embodied from a plastic material, for example a sheet silicate, in particular mica.

The second support element 30*a* is embodied in longitudinal form, and defines a second longitudinal extension direction 62*a*. The second longitudinal extension direction 62*a* is perpendicular to the first longitudinal extension direction 60*a*. Accordingly, the second support element 30*a* is arranged perpendicular to the first support element 28*a*. The second support element 30*a* is embodied as a rigid body. The second support element 30*a* is embodied in elongated form. The second support element 30*a* embodied in a strip-like manner. The second support element 30*a*, in particular a wing of the second support element 30*a*, is oriented parallel to the heating coil 10*a*, in particular the coil plane 50*a*. The second support element 30*a* extends from a third longitudinal side of the heating coil 10*a* to a fourth longitudinal side of the heating coil 10*a* lying opposite the third longitudinal side. The second longitudinal extension direction 62*a* of the second support element 30*a* here runs through the coil axis 52*a*. The second support element 30*a* is further embodied from an electrically insulating material. In the present case, the second support element 30*a* is embodied from a plastic material, for example from a sheet silicate, in particular mica. Alternatively, it is conceivable to embody a first and/or a second support element from a metal. In addition, a first and a second support element could have a parallel orientation. Additionally, at least one support element could be embodied from a material other than sheet silicate, such as, for example, a plastic.

The fixing device 14*a* further comprises a retaining unit 18*a*. The retaining unit 18*a* is embodied as a mechanical structural unit. The retaining unit 18*a* is embodied from a material with a thermal expansion coefficient which is essentially identical to a thermal expansion coefficient of the heating coil 10*a*. The retaining unit 18*a* is embodied from a metallic material. The retaining unit 18*a* consists in the present case at least for the most part of steel, in particular copper-clad steel. Alternatively, it is also possible to embody a retaining unit in any desired material other than copper, such as for example a plastic, and/or as an adhesive retaining unit. The retaining unit 18*a* is arranged on the heating coil 10*a*. The retaining unit 18*a* is further arranged on the support unit 16*a*. The retaining unit 18*a* is provided to fix each of the windings 12*a*, 13*a* of the heating coil 10*a* separately on the support unit 16*a* in an assembled state.

To this end, the retaining unit 18*a* comprises a multiplicity of retaining elements 20*a*, 22*a*, 24*a*, 26*a*, 64*a*, 66*a*, 68*a*, 70*a*, wherein in FIG. 2*a*, for the sake of clarity, only eight of the retaining elements 20*a*, 22*a*, 24*a*, 26*a*, 64*a*, 66*a*, 68*a*, 70*a* have been provided with reference characters. The number of retaining elements 20*a*, 22*a*, 24*a*, 26*a*, 64*a*, 66*a*, 68*a*, 70*a* is here matched to the number of windings 12*a*, 13*a*. In the present case, exactly four retaining elements 20*a*, 22*a*, 24*a*, 26*a*, 64*a*, 66*a*, 68*a*, 70*a* are assigned to each of the windings 12*a*, 13*a* of the heating coil 10*a*. The retaining elements 20*a*, 22*a*, 24*a*, 26*a*, 64*a*, 66*a*, 68*a*, 70*a* are here in each case embodied identically to each other. In the present case, the retaining elements 20*a*, 22*a*, 24*a*, 26*a*, 64*a*, 66*a*, 68*a*, 70*a* are in each case embodied as clips. Alternatively, however, it is also conceivable, to assign one and/or two retaining elements to each winding of a heating coil. It is also conceivable to assign one retaining element to two and/or three windings in each case. Furthermore, it is possible to embody retaining elements differently from each other and/or to combine differently embodied retaining elements with each other.

In the present case, four retaining elements 20*a*, 22*a*, 24*a*, 26*a*, in particular a first retaining element 20*a*, a second retaining element 22*a*, a third retaining element 24*a* and a fourth retaining element 26*a*, are assigned to a winding 12*a* of the heating coil 10*a*. The retaining elements 20*a*, 22*a*, 24*a*, 26*a* here fix the winding 12*a* onto the support elements 28*a*, 30*a*. The retaining elements 20*a*, 22*a*, 24*a*, 26*a*, are evenly distributed along a loop of the winding 12*a*. The retaining elements 20*a*, 22*a*, 24*a*, 26*a* are spaced by rotation through 90° relative to the coil center point 48*a*. The first retaining element 20*a* is arranged in the center of a first straight coil section 74*a* of the heating coil 10*a*. The second retaining element 22*a* is arranged in the center of a second straight coil section 76*a* of the heating coil 10*a*. The third retaining element 24*a* is arranged in the center of a third straight coil section 78*a* of the heating coil 10*a*. The fourth retaining element 26*a* is arranged in the center of a fourth straight coil section 80*a* of the heating coil 10*a*.

Four further retaining elements 64*a*, 66*a*, 68*a*, 70*a*, in particular a fifth retaining element 64*a*, a sixth retaining element 66*a*, a seventh retaining element 68*a* and an eighth retaining element 70*a*, are assigned to the further winding 13*a* of the heating coil 10*a*. The further retaining elements 64*a*, 66*a*, 68*a*, 70*a* here fix the further winding 13*a* onto the support elements 28*a*, 30*a*. The further retaining elements 64*a*, 66*a*, 68*a*, 70*a* are evenly distributed along a loop of the further winding 13*a*. The further retaining elements 64*a*, 66*a*, 68*a*, 70*a* are spaced by rotation through 90° relative to the coil center point 48*a*. The fifth retaining element 64*a* is arranged in the center of the first straight coil section 74*a* of the heating coil 10*a*. The sixth retaining element 66*a* is arranged in the center of the second straight coil section 76*a* of the heating coil 10*a*. The seventh retaining element 68*a* is arranged in the center of the third straight coil section 78*a* of the heating coil 10*a*. The eighth retaining element 70*a* is arranged in the center of the fourth straight coil section 80*a* of the heating coil 10*a*. In the case of a thermal expansion of the heating coil 10*a*, a movement of the winding 12*a* relative to the further winding 13*a* is prevented by means of the retaining elements 20*a*, 22*a*, 24*a*, 26*a*, 64*a*, 66*a*, 68*a*, 70*a*.

FIG. 2*b* shows a detail view of the heating coil 10*a* and of the fixing device 14*a* in a cutaway drawing. The section comprises the winding 12*a*, the further winding 13*a*, the support element 28*a* and, by way of example, the first retaining element 20*a* and the fifth retaining element 64*a*. The following description can, however, be transferred analogously to the other retaining elements 22*a*, 24*a*, 26*a*, 66*a*, 68*a*, 70*a* and/or the other support element 30*a*.

The first retaining element 20*a* and the fifth retaining element 64*a* are embodied as a wire-like body. The first retaining element 20*a* and the fifth retaining element 64*a* encompass a respective winding 12*a*, 13*a* at least for the most part. The first retaining element 20*a* and the fifth retaining element 64*a* here penetrate the support element 28*a*, so that an end area 82*a*, 84*a* of the first retaining element 20*a* and an end area 86*a*, 88*a* of the fifth retaining element 64*a* engage behind the support element 28*a* and hereby in particular fix the windings 12*a*, 13*a* onto the support element 28*a*.

FIG. 2*c* shows the detail view of the heating coil 10*a* and the fixing device 14*a* viewed from above. The cooking device comprises a positioning unit 34*a*. The positioning unit 34*a* is provided for positioning of the retaining unit 18*a* and the support unit 16*a* relative to the heating coil 10*a*. To this end, the positioning unit 34*a* comprises a number of positioning elements 35*a*, wherein, for the sake of clarity, in FIG. 2*c* in particular only one of the positioning elements is provided with a reference character. The number of positioning elements 35*a* is here matched to the number of retaining elements 20*a*, 22*a*, 24*a*, 26*a*, 64*a*, 66*a*, 68*a*, 70*a*. In the present case, exactly one positioning element 35*a* is assigned to each of the retaining elements 20*a*, 22*a*, 24*a*, 26*a*, 64*a*, 66*a*, 68*a*, 70*a*. The positioning elements 35*a* are here identical to each other.

The positioning element 35*a* is embodied in one piece with the winding 12*a* of the heating coil 10*a*. The positioning element 35*a* is embodied as a recess in the winding 12*a* of the heating coil 10*a*. The positioning element 35*a* is embodied bilaterally in the winding 12*a*. The positioning element 35*a* is embodied corresponding to the first retaining element 20*a*. Alternatively, it is also conceivable to dispense totally or at least partially with a positioning unit. It is further conceivable to embody a positioning element on one side only in a winding.

Figure 2D:
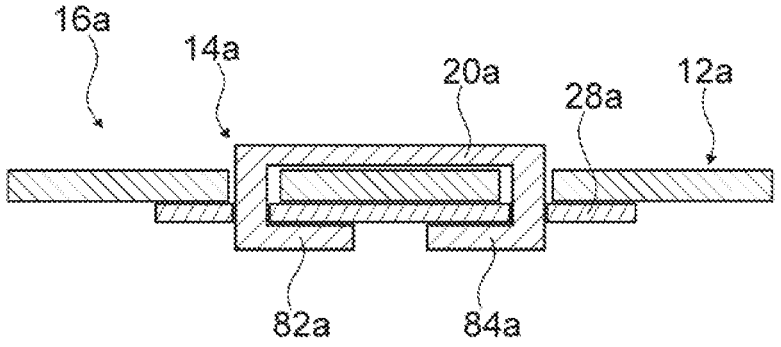
FIG. 2*d* shows a third detail view of the heating coil and the fixing device.

FIG. 2*d* shows a detail view of the heating coil 10*a* and of the fixing device 14*a*, as described in FIGS. 2*b* and 2*c*, wherein a longitudinal section in the direction of the winding 12*a* is represented. This embodiment differs from the previous embodiments in that the winding 12*a* has positioning elements 35*a* in the form of recesses in the center of the winding 12*a*, and the first retaining element 20*a* connects the winding 12*a* to the support element 28*a* by means of two positioning elements 35*a*, wherein the first retaining element 20*a* penetrates the support element 28*a*. Alternatively, it could have a single positioning element 35*a* and the first retaining element 20*a* could penetrate it through one side of the winding 12*a*, by means of which this fixes the winding 12*a* to the support element 28*a*.

Figure 2E:
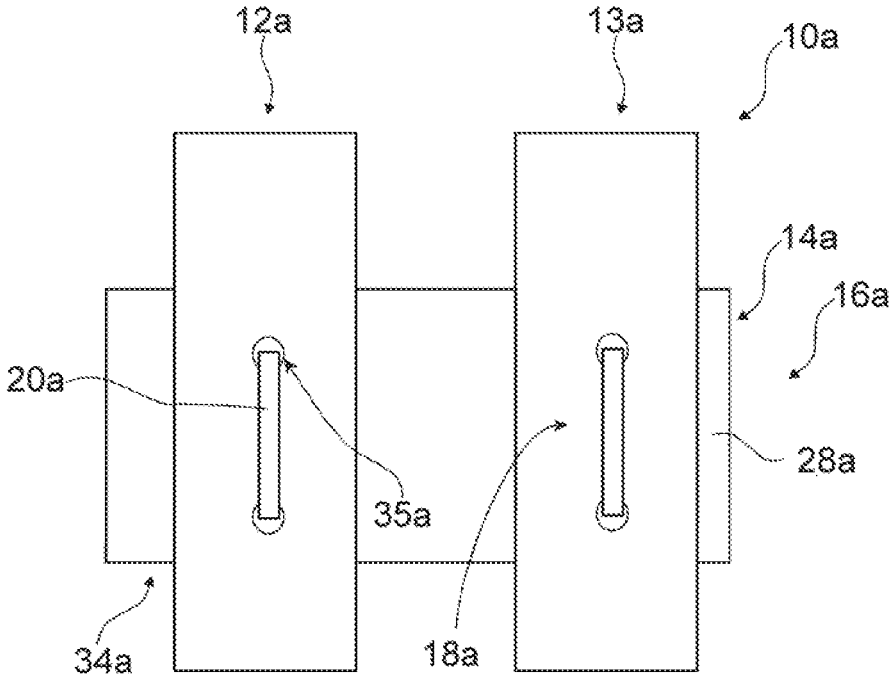
FIG. 2*e* shows a fourth detail view of the heating coil and the fixing device.

FIG. 2*e* shows a detail view of the heating coil 10*a* and the fixing device 14*a*, viewed from above FIG. 2*d*.

FIGS. 3*a* to 6 show further exemplary embodiments of the invention. The subsequent descriptions and the drawings confine themselves essentially to the differences between the exemplary embodiments, wherein with regard to identically designated components, in particular with regard to components with the same reference character, reference can also in principle be made to drawings and/or the description of the other exemplary embodiments, in particular from FIGS. 1 to 2*c*. To distinguish the exemplary embodiments, the letter 'a' is appended to the reference characters of the exemplary embodiment in FIGS. 1 to 2*c*. In the exemplary embodiments from FIGS. 3*a* to 6, the letter 'a' is replaced by the letters 'b' to 'e'.

Figure 3A:
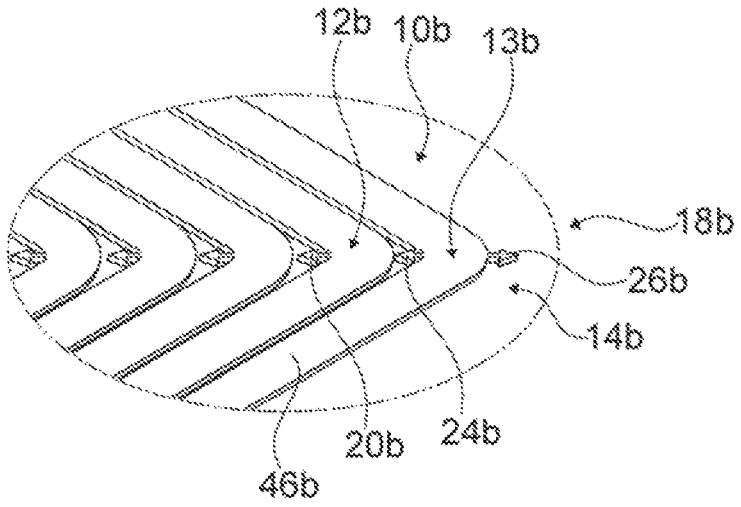
FIG. 3*a* shows a further exemplary embodiment of a further cooking device with a heating coil and a fixing device in a first detail view.
Figure 3B:
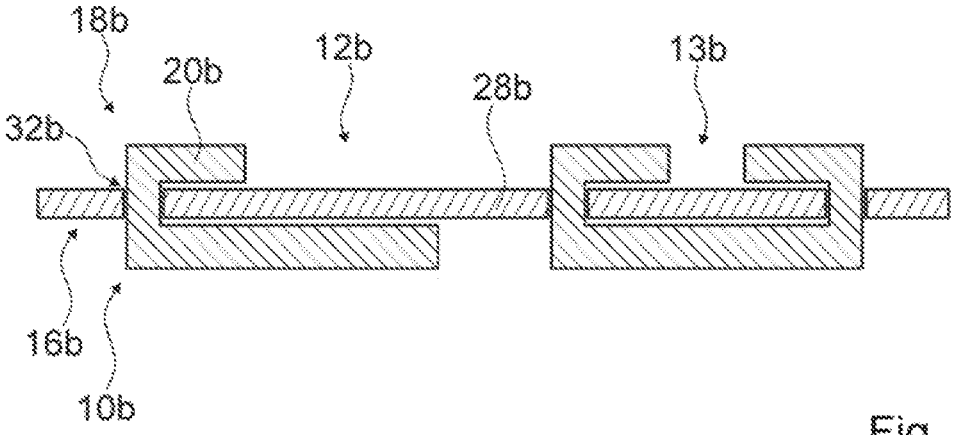
FIG. 3*b* shows a heating coil and the fixing device from FIG. 3*a* in a second detail view.

FIGS. 3*a* and 3*b* show a further exemplary embodiment of the invention. The letter 'b' is appended to the reference characters of this exemplary embodiment. The further exemplary embodiment from FIGS. 3*a* and 3*b* differs from the previous exemplary embodiment at least essentially in an embodiment of a retaining unit 18*b* of a fixing device 14*b*.

In this case a retaining element 20*b*, 24*b*, 26*b* of the retaining unit 18*b* is embodied in one piece with a heating coil 10*b*, in particular a winding 12*b*, 13*b* of the heating coil 10*b*. In the present case, at least one retaining element 20*b*, 24*b*, 26*b* is assigned to each winding 12*b*, 13*b*. Exactly one retaining element 20*b* is here assigned to inner windings of the heating coil 10*b*, while two retaining elements 24*b*, 26*b* are assigned to an outermost winding 13*b* of the heating coil 10*b*. The retaining elements 20*b*, 24*b*, 26*b* have an arrow-shaped contour. The retaining elements 20*b*, 24*b*, 26*b* are embodied as retaining hooks. The retaining elements 20*b*, 24*b*, 26*b* are arranged in corner areas of the heating coil 10*b* and extend in the direction of a coil center point. Alternatively, a retaining element can have a different form, for example a tip.

Furthermore, in the present case in particular a support unit 16*b* comprises at least one support element 28*b* of the support unit 16*b*, at least one retaining recess 32*b*. In the present case, the support unit 16*b* comprises a number of retaining recesses 32*b*, wherein for the sake of clarity in FIG. 3*b* in particular only one of the retaining recesses 32*b* is provided with reference characters. The number of retaining recesses 32*b* is here matched to the number of retaining elements 20*b*, 24*b*, 26*b*. In the present case exactly one retaining recess 32*b* is assigned to each of the retaining elements 20*b*, 24*b*, 26*b*. The retaining recesses 32*b* are in each case embodied corresponding to the retaining elements 20*b*, 24*b*, 26*b*. The retaining recesses 32*b* are here identical to each other. The retaining recesses 32*b* are provided to accommodate the retaining unit 18*b*, in particular the retaining elements 20*b*, 24*b*, 26*b*.

Figure 4:
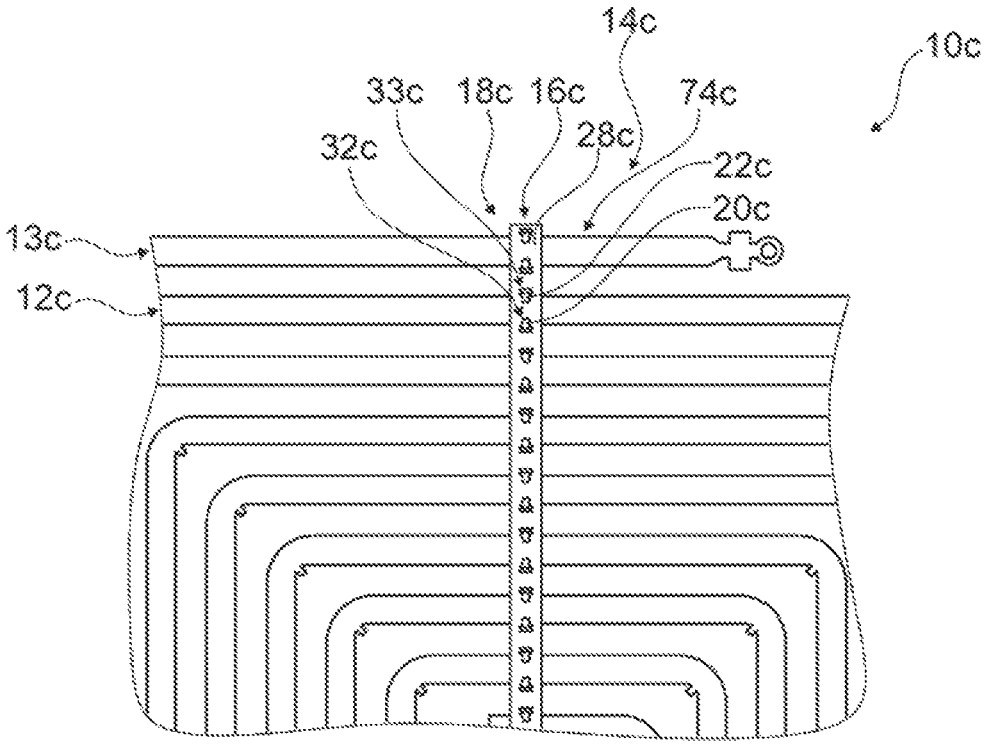
FIG. 4 shows a further exemplary embodiment of a further cooking device with a heating coil and a fixing device in a detail view.

FIG. 4 shows a further exemplary embodiment of the invention. The letter 'c' is appended to the reference characters of the exemplary embodiment from FIG. 4. The further exemplary embodiment from FIG. 4 differs from the previous exemplary embodiment at least essentially in an embodiment of a retaining unit 18*c* of a fixing device 14*c*.

In this case, two retaining elements 20*c*, 22*c*, 24*c*, 26*c* are assigned to each winding 12*c*, 13*c* of a heating coil 10*c*. The retaining unit 18*c* with the retaining elements 20*c*, 22*c* is here arranged centrally in a straight coil section 74*c* of the winding 12*c*. In addition, a retaining recess 32*c* of a support unit 16*c* is assigned to each of the retaining elements 20*c*, 22*c*, 24*c*, 26*c*.

Figure 5A:
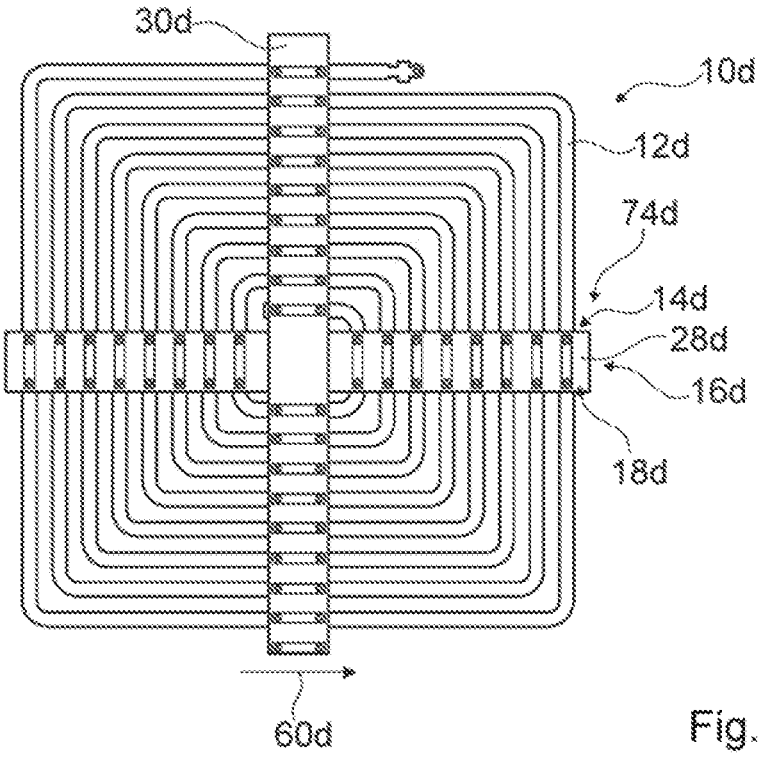
FIG. 5*a* shows a further exemplary embodiment of a further cooking device viewed from above
Figure 5B:
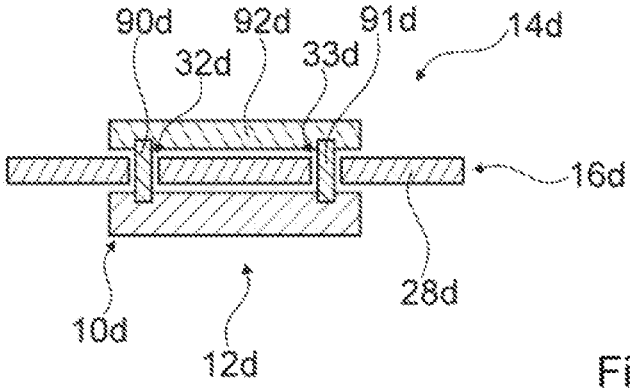
FIG. 5*b* shows the heating coil and the fixing device from FIG. 5*a* with a heating coil and a fixing device in a first detail view and FIG. 6 shows a further exemplary embodiment of a further cooking device with a heating coil and a fixing device viewed from above.

FIGS. 5*a* and 5*b* show a further exemplary embodiment of the invention. The letter 'd' is appended to the reference characters of the exemplary embodiment from FIGS. 5*a* and 5*b*. The further exemplary embodiment from FIGS. 5*a* and 5*b* differs from the previous exemplary embodiments at least essentially in an embodiment of a retaining unit 18*d* of a fixing device 14*d*.

FIG. 5*a* shows a heating coil 10*d* and the fixing device 14*d* viewed from above. In this embodiment, at least twelve retaining parts of the retaining unit 18*d* are assigned to a winding 12*d*. At least twelve retaining elements of the retaining unit 18*d* are assigned to each winding 12*d* of the heating coil 10*d*. In this exemplary embodiment, a support element 28*d* is arranged along a longitudinal extension direction 60*d* of a support unit 16*d* centrally between straight coil sections 74*d*. In the present case, the support element 28*d* is arranged perpendicular to a further support element 30*d*.

FIG. 5*b* shows a detail view of the fixing device 14*d*. In this case, retaining elements of the retaining unit 18*d* are embodied in multipart form and in the present case comprise for example three retaining parts 90*d*, 91*d*, 92*d*. Two retaining parts 90*d*, 91*d* are in each case embodied as bolts with a circular cross-section. A third retaining part 92*d* is embodied as a retaining clip.

A support unit 16*d* is here arranged between heating coil 10*d* and the third retaining part 92*d*, while the first and the second retaining part 90*d*, 91*d* in each case penetrate a retaining recess 32*d*, 33*d*, in order to realize a form-fitted and force-fitted connection. The form-fitted and force-fitted connection is embodied by means of a spot-welding method. Alternatively, or additionally, stapling, riveting and/or compression methods can also be employed.

Figure 6:
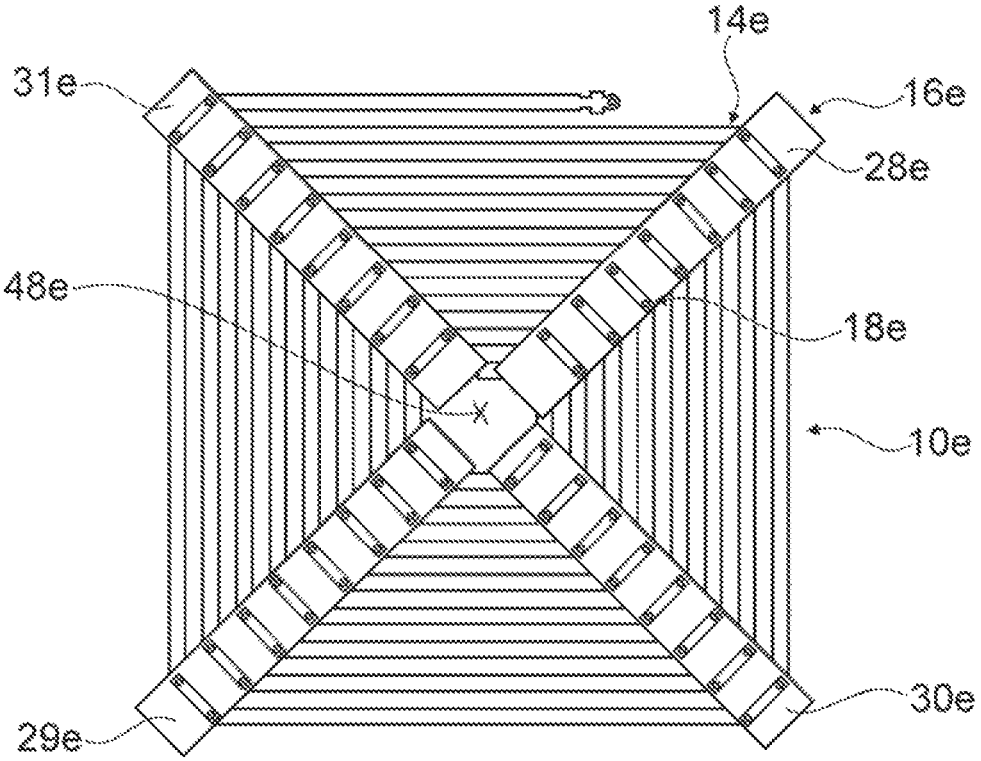

FIG. 6 shows a further exemplary embodiment of the invention. The letter 'e' is appended to the reference characters of the exemplary embodiment from FIG. 6. The further exemplary embodiment from FIG. 6 differs from the previous exemplary embodiment at least essentially in an arrangement of a support unit 16*e* of a fixing device 14*e* and/or the number of support elements 28*e*, 29*e*, 30*e*, 31*e* of the support unit 16*e*.

A retaining unit 18*e* corresponds at least essentially to a retaining unit 18*d* of the previous exemplary embodiment. In this exemplary embodiment, however, the support unit 16*d* comprises four support elements 28*e*, 29*e*, 30*e*, 31*e*. The support elements 28*e*, 29*e*, 30*e*, 31*e* are oriented perpendicularly to each other. The support elements 28*e*, 29*e*, 30*e*, 31*e* here extend radially in the direction of a coil center point 48*e*, starting from a corner area of a heating coil 10*e*.

The invention claimed is:

1. A cooking device, comprising:

a heating coil including at least two windings;

a support unit; and a retaining unit, which in the assembled state fixes each of the at least two windings separately on the support unit, the retaining unit having a plurality of retaining elements.

2. The cooking device of claim 1, wherein the retaining unit is made at least partially of a material with a thermal expansion coefficient which is at least essentially identical to a thermal expansion coefficient of the heating coil.

3. The cooking device of claim 1, wherein at least two of the retaining elements are assigned to at least one of the at least two windings.

4. The cooking device of claim 1, wherein the retaining unit is an integral piece of the heating coil.

5. The cooking device of claim 1, wherein each of the retaining elements is embodied as a retaining clasp, a retaining hook, a retaining clip and/or a retaining bolt.

6. The cooking device of claim 1, wherein the support unit is embodied at least partially to be electrically insulating.

7. The cooking device of claim 1, wherein the support unit includes a multiplicity of at least essentially strip-like support elements.

8. The cooking device of claim 1, wherein the support unit has at least one retaining recess to accommodate the retaining unit.

9. The cooking device of claim 1, further comprising a positioning unit configured to position at least one of the retaining unit and the support unit relative to the heating coil.

10. The cooking device of claim 1, wherein the support unit is arranged between one of the retaining elements and the heating coil, the one of the retaining elements penetrating a retaining recess of the support unit to establish a connection to the heating coil.

11. The cooking device of claim 1, wherein each retaining element contacts only one of the windings.

12. A cooking appliance, comprising a cooking device, said cooking device comprising a heating coil including at least two windings;

a support unit; and a retaining unit, which in the assembled state fixes each of the at least two windings separately on the support unit, the retaining unit having a plurality of retaining elements.

13. The cooking appliance of claim 12, wherein the retaining unit is made at least partially of a material with a thermal expansion coefficient which is at least essentially identical to a thermal expansion coefficient of the heating coil.

14. The cooking appliance of claim 12, wherein at least two of the retaining elements are assigned to at least one of the at least two windings.

15. The cooking appliance of claim 12, wherein the retaining unit is an integral piece of the heating coil.

16. The cooking appliance of claim 12, wherein the support unit is embodied at least partially to be electrically insulating.

17. The cooking appliance of claim 12, wherein the support unit includes a multiplicity of at least essentially strip-like support elements.

18. The cooking appliance of claim 17, wherein in an assembled state the support elements are arranged at least essentially perpendicular to each other.

19. The cooking appliance of claim 12, wherein the support unit has at least one retaining recess to accommodate the retaining unit.

20. The cooking appliance of claim 12, wherein the cooking device includes a positioning unit configured to position at least one of the retaining unit and the support unit relative to the heating coil.

21. The cooking appliance of claim 12, wherein the support unit is arranged between one of the retaining elements and the heating coil, the one of the retaining elements penetrating a retaining recess of the support unit to establish a connection to the heating coil.

22. The cooking appliance of claim 12, wherein each retaining element contacts only one of the windings.

23. A method for assembly of a cooking device, the method comprising:

at least partially mechanically fixing a heating coil of the cooking device to a support unit such that each of at least two windings of the heating coil is fixed separately to the support unit by a retaining unit, the retaining unit having a plurality of retaining elements.

* * * * *